US005289610A

United States Patent [19]

Monson

[11] Patent Number: 5,289,610

[45] Date of Patent: Mar. 1, 1994

[54] RECYCLING EXTRACTION CLEANER AND DRIER

[76] Inventor: Clifford L. Monson, 6115 130th Ave., NE., Kirkland, Wash. 98033

[21] Appl. No.: 980,206

[22] Filed: Nov. 23, 1992

[51] Int. Cl.[5] ..... A47L 5/24

[52] U.S. Cl. ..... 15/320; 15/344; 15/353

[58] Field of Search ..... 15/320, 321, 344, 353, 15/418-421; 55/403

[56] References Cited

U.S. PATENT DOCUMENTS

| | | | |
|---|---|---|---|
| 2,355,322 | 8/1944 | Nuffer et al. | 15/344 |
| 2,986,764 | 6/1961 | Krammes | 15/320 |
| 3,040,362 | 6/1962 | Krammes | 15/320 |
| 3,072,950 | 1/1963 | Duff et al. | 15/320 |
| 3,117,337 | 1/1964 | Krammes | 15/320 |
| 3,332,101 | 7/1967 | Leinfelt et al. | 15/421 |
| 3,848,291 | 11/1974 | Morse | 15/322 |
| 4,156,952 | 6/1979 | Lynch, Jr. | 15/320 |
| 4,542,557 | 9/1985 | Levine | 15/344 |
| 4,549,329 | 10/1985 | St. Clair | 15/353 |
| 4,566,149 | 1/1986 | Fitzwater | 15/320 |
| 4,597,127 | 7/1986 | Williams, III et al. | 15/321 |
| 4,788,738 | 12/1988 | Monson et al. | 15/320 |
| 4,930,178 | 6/1990 | Monson et al. | 15/320 |
| 5,050,266 | 9/1991 | Schneider | 15/330 |
| 5,060,339 | 10/1991 | Evers | 15/344 |
| 5,168,599 | 12/1992 | Williams | 15/320 |
| 5,169,445 | 12/1992 | Yonehara et al. | 15/320 |

*Primary Examiner*—Stephen F. Gerrity
*Assistant Examiner*—Patrick F. Brinson
*Attorney, Agent, or Firm*—Sixbey, Friedman, Leedom & Ferguson

[57] ABSTRACT

A recycling extraction cleaner and dryer is provided which includes a unitary body member having a vacuum blower chamber, a plenum chamber and a nozzle head including a drying air discharge, a cleaning fluid discharge and a vacuum intake. A cleaning fluid container is removably mounted on the body to communicate with the cleaning fluid discharge, and a vacuum generator in the vacuum blower chamber creates a vacuum in the plenum chamber which communicates with the vacuum intake. The vacuum generator creates an exhaust air flow in the vacuum blower chamber which is directed to the drying air discharge to provide drying air under pressure to a surface to be cleaned and to increase the pressure differential between the plenum chamber and the surface contacting side of the nozzle head.

13 Claims, 1 Drawing Sheet

RECYCLING EXTRACTION CLEANER AND DRIER

TECHNICAL FIELD

The present invention relates generally to recycling-type extraction cleaners and more specifically to a cleaner which is compact, light-weight, portable and which applies cleaning fluid to a soiled area of a surface and then extracts the applied fluid.

BACKGROUND ART

Cleaning machines of the type wherein a washing liquid is fed from a receptacle to a surface to be washed and, then, by means of suction, is returned to the original receptacle for further use, preferably after being filtered are known. Often these units include a tank-like receptacle that houses a pump for dispensing the cleaning liquid, a suction fan for returning the liquid, and a filtering means, while also providing the storage facility for the cleaning liquid. The tank-like receptacle is designed to sit on the floor and flexible liquid discharge and liquid return hoses connect the tank-like receptacle with a cleaning head used to apply and retrieve the cleaning liquid from the surface being cleaned.

While devices of the aforementioned type are portable, they are anything but compact and lightweight, particularly when their cleaning fluid tank is full. Furthermore, the presence in such apparatus of a tank that must rest on the floor not only makes use of the apparatus cumbersome, but is restrictive with respect to the places that such a unit can be effectively utilized. For example, long flights of steps having no landing upon which the tank can rest can render the apparatus unusable. Furthermore, because of the cumbersome nature of such units, it is often impractical to utilize the unit for spot cleaning purposes, such as cleaning up a small spill, as opposed to general room cleaning.

As a result, it is desirable to have a cleaning apparatus wherein all of the operative components are mounted upon a common element so that the unit is unencumbered by a separate floor-supported tank. In view of this, floor cleaning devices have been configured to be similar to an upright vacuum cleaner or so-called electric broom, and have all of the operative components for spraying a cleaning fluid onto a floor surface, such as a carpet, and for using suction to collect the dirty cleaning liquid, as well as a means for storing the fluid that is applied and collected mounted upon a common element. However, such devices are often not constructed to enable recycling of the cleaning fluid, and therefore the cleaning capacity of the apparatus is severely limited by the amount of fluid that can be carried. Furthermore, the versatility of such "common element" type cleaning apparatus is severely restricted to floor-type uses because these units are too large and heavy to be used in a manner that is unsupported by contact with the floor surface to be cleaned and because the units are not designed for operation in orientations that would be necessary for cleaning vertical surfaces.

To overcome these disadvantages, relatively small, light-weight, easily portable and versatile cleaning units have been developed which recycle the cleaning fluid employed so that the cleaning capacity of the unit is not limited to the surface area that can be cleaned with a single application of a limited quantity of cleaning fluid carried by the unit. Instead, the fluid which is applied to a surface and then vacuumed back into the unit is recycled and used again. My previous U.S. Pat. Nos. 4,788,738 and 4,930,178 show improved cleaners of this type.

A common feature of all prior cleaners which first apply and then vacuum cleaning fluid from a surface is that the fluid removed from the surface is limited to that which can be entrained in a vacuum stream collated by a suction or vacuum generator mounted on the device. If the surface is formed by a carpet or other fluid absorbent material, a significant amount of the fluid will be absorbed and may remain after the vacuum operation is complete. This leaves an area which remains wet, often for several hours, until normal air drying occurs.

DISCLOSURE OF THE INVENTION

It is a primary object of the present invention to provide a novel and improved recycling extraction cleaner and drier which operates to apply cleaning fluid to a surface, withdraw the cleaning fluid by vacuum from the surface, dry the surface with heated air, and recycle the withdrawn cleaning fluid for subsequent use.

Another object of the present invention is to provide a novel and improved recycling extraction cleaner and drier which directs the heated exhaust air from a vacuum motor and blower back onto a surface which has been previously treated with cleaning fluid.

A further object of the present invention is to provide a novel and improved recycling extraction cleaner and drier adapted to either direct heated exhaust air from a vacuum motor and blower back onto a surface which has been previously treated with cleaning fluid or to exhaust said air to the atmosphere.

A still further object of the present invention is to provide a novel and improved recycling extraction cleaner and drier adapted to direct heated exhaust air around the entire periphery of an area containing a cleaning fluid spray head and a vacuum intake slot. The heated air provides an air barrier to concentrate the sprayed cleaning fluid within the confines of the air barrier and to aid in agitating cleaning fluid and dirt on a surface to enhance a vacuuming process. The exhaust air also increases the pressure differential between a suction creating plenum chamber within the cleaner and the underside of a surface contacting nozzle head to enhance the pick-up of cleaning fluid and dirt by the cleaner.

Yet a further object of the present invention is to provide a novel and improved recycling extraction cleaner and drier having a vacuum blower which exhausts substantially dry, hot air onto an area to which cleaning fluid has been previously applied. Cleaning fluid and dirt are drawn back into the cleaner by the vacuum created by the vacuum blower and are removed from the return airstream to the blower by an inclined baffle system consisting of superimposed baffles which cause the air to follow a tortuous path to the vacuum blower. At the blower, the air is heated and returned under pressure to the cleaning fluid bearing area.

BEST MODE FOR CARRYING OUT THE INVENTION

Figure 1:
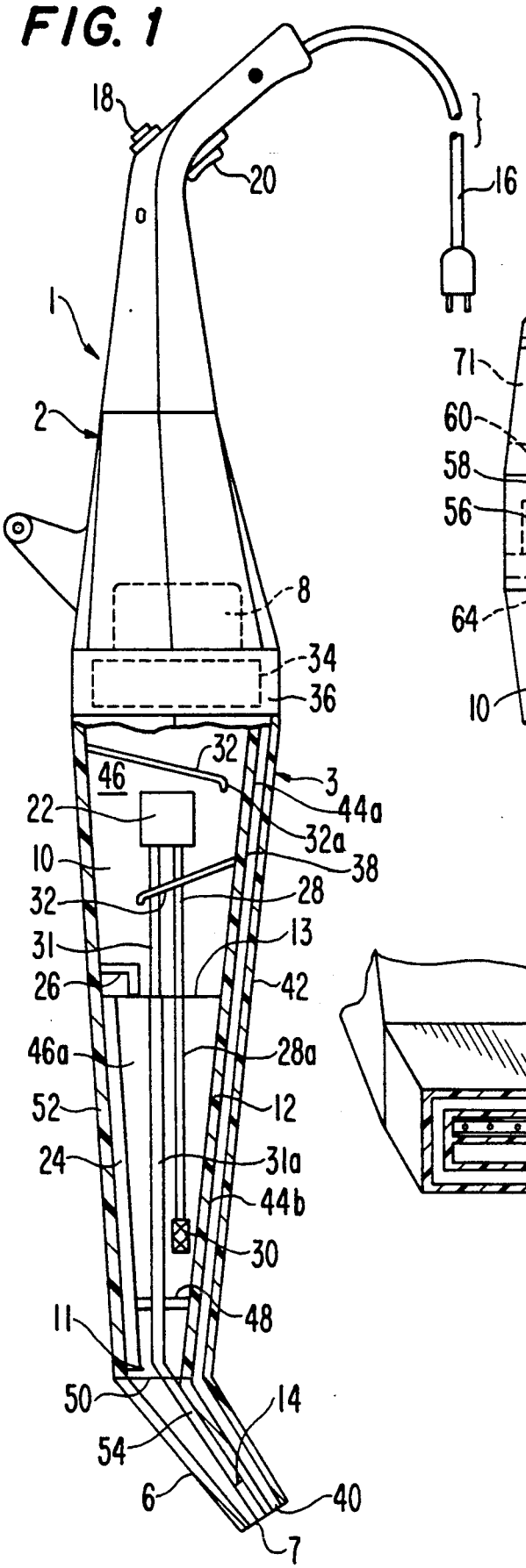
FIG. 1 is a partial cross sectional view of the recycling extraction cleaner and drier of the present invention.

With reference to the drawings, the cleaning unit 1 of the present invention is formed with a unitary body having two main body sections, namely an upper handle section 2 and a lower discharge head section 3 that are molded to form the unitary body. The upper section 2 terminates in a handle 4, while the lower section 3 terminates in a nozzle head 6 having a downward facing vacuum intake opening 7.

It should be appreciated that the cleaning unit 1 in accordance with the present invention utilizes a pump system for applying a spray of cleaning fluid to the surface to be cleaned, a vacuum extraction system to recover applied cleaning fluid and dirt entrained therewith, and a heated air system to aid in the drying of the surface to which cleaning fluid has been applied. To this end, a vacuum blower having a motor 8 (disposed at the lower end of the handle section 2) defines the upper end of a hollow plenum chamber 10 formed within the lower section 3 of the extraction cleaner unit 1. The plenum chamber 10 is, itself, essentially an extension of a hollow cleaning fluid receptacle 12 which is removable from the remainder of the unit 1 by pulling it outwardly from the front of the unit. When the receptacle 12 is snapped in place within a seating space 11 between the plenum chamber and the nozzle head, gaskets or other conventional seals can be mounted on the receptacle and/or the unit, to form a leakproof seal along the juncture 13.

A spray of cleaning fluid may be selectively applied via a spray nozzle 14 when a power cord 16 is plugged into an electrical outlet and a pump switch 20 is actuated. The pump switch activates a self-priming pump 22, shown mounted to the inner wall of the unit 1 above the cleaning fluid receptacle. In particular, the pump 22 draws cleaning solution from the cleaning fluid receptacle 12, through a filter 30, and up a conduit 28 to the pump, after which it is delivered, under pressure, through a spray conduit 31 to the spray nozzle 14. In this regard, while the conduit 28 may be a separate flexible tube which projects into the receptacle 12, preferably, both the conduits 28 and 31 are formed by a molded or otherwise built-in portion of the wall of the receptacle 2 so as to mate with similar conduit built-in portions **28*a* and 31*a* leading to the pump. The filter 30 prevents any solid matter that has been extracted along with the cleaning fluid into the receptacle 12 from being drawn up into the pump 22 which could lead to the pump becoming damaged or the nozzle 14 or conduits 28 and 31** becoming clogged.

In order to enable the applied cleaning fluid to be extracted by the vacuum blower via the intake opening 7 of the head 6 (upon actuation of the vacuum blower switch 18), intake opening 7 communicates with the top of receptacle 12 (that communicates with the intake side of the vacuum blower via the hollow plenum chamber 10) via the conduit 24 and deflection conduit 26. These conduits also are preferably built into the wall of lower section 3, such as by being molded portions of a plastic lower body section 3.

While the deflection conduit 26 serves to direct the returning cleaning fluid, and any solid materials extracted therewith, into receptacle 12, in order to further insure that no liquid or solid matter is drawn into the vacuum motor 8, advantageously, at least two drift eliminator blades 32 are provided. These superimposed blades 32 alternatively extend from a respective one of opposite facing walls (front and back walls as shown) and widthwise extend almost fully across the width of the plenum chamber (i.e., from one side wall to the opposite side wall). Each of the eliminator blades 32 angles downwardly and terminates at a free edge **32*a* that is formed with a 90° angle bend. As a result of the presence of these drift eliminator blades, air drawn upwardly into the vacuum blower is caused to following a meandering path and any liquids or solids entrained therewith will be brought into contact with these blades and then deflected back down from the plenum chamber 10 into the fluid receptacle 12, thereby avoiding such materials being drawn into the blower motor 8**.

The vacuum motor 8 drives an impeller 34 and both are contained in a chamber 36 and operate to lower the pressure in the plenum chamber 10. Air drawn into the chamber 36 is exhausted from the chamber under pressure down through a conduit 38 to the head 6. The chamber 36 in the embodiment of FIG. 1 can only exhaust into the conduit 38, and thus exhaust air under pressure which has been heated by the motor 8 passes out through a slot 40 in the head 6. This heated exhaust air contacts cleaning fluid applied by the spray nozzle 14 which has penetrated a carpet or other surface so as not to be completely removed by suction through the intake opening 7.

The conduit 38 is formed between an outer back wall 42 for the cleaning unit 1 and an inner back wall 44 spaced from the outer back wall. Inner back wall 44 extends across the cleaning unit between the spaced sidewalls thereof, one of which is shown at 46, to form a closed conduit which is open only at a top end into the chamber 36 and at a bottom end at the slot 40. The outer back wall 42 and an upper section **44*a* of the inner back wall are molded as part of a unitary cleaner unit body, while a lower section 44*b* of the inner back wall, which mates with section 44*a*, forms the back wall of the removable cleaning fluid receptacle 12**.

The cleaning fluid receptacle 12 has a bottom wall 48 which closes the bottom of the receptacle so that the receptacle only opens at the top along the line 13 into the plenum chamber 10. The receptacle mates with the remainder of the cleaner unit along the top edge indicated by line 13 and along the bottom edge indicated at 50. The receptacle, including the conduit sections **28*a* and 31*a*, molded into a sidewall 46*a* of the receptacle and the conduit 24 molded into a front wall 52 thereof may be withdrawn from the cleaner unit so that dirty cleaning fluid which has been recycled a number of times can be removed and replaced with clean cleaning fluid. Then the receptacle is replaced in the seating space 11 defined by the edges 13 and 50 causing the conduit 28*a* to mate with the conduit 28 while the conduit 31*a* mates with the conduit 31 and a nozzle conduit 54 leading to the spray nozzle 14**.

Figure 2:
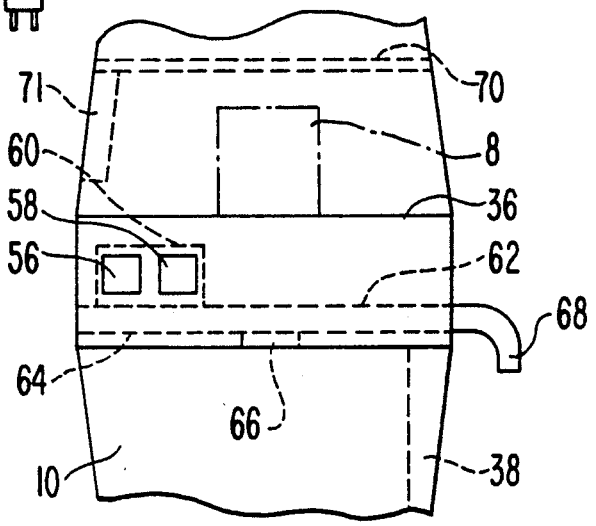
FIG. 2 is a view in side elevation of a second embodiment of the vacuum blower chamber for the recycling extraction cleaner and drier.

In some instances, it may be desirable to use the cleaning unit 1 as a dry vacuum cleaner without the application of cleaning fluid or drying air. For this purpose, as illustrated in FIG. 2, the chamber 36 may be provided with vents 56 and 58 which communicate between the chamber and the atmosphere outside the cleaner unit 1. These vents may be normally closed by a closure plate 60 mounted on a slide bar 62 which slides in a track 64 molded on the inner wall of the chamber 36. A second closure plate 66 mounted on the slide bar is adapted to close off the end of the conduit 38 when the vents 56 and 58 are opened.

To facilitate operation of the slide bar 62, the slide bar extends outwardly from the cleaner unit, and terminates in a finger tab 68. When the finger tab is drawn to the right in FIG. 2, the vents 56 and 58 are opened and the conduit 38 is closed. Now the vacuum motor 8 and impeller 34 will be vented to the atmosphere and heated, drying air will not be provided to the nozzle head. When the slide bar 62 is returned to the position shown in FIG. 2, the vents 56 and 58 are blocked and heated air is provided through the conduit 38 which now provides the only vent path from the chamber 36.

In some cases, it may be desirable to provide an internal wall 70 above the vacuum motor 8 to reduce the size of the chamber 36 and thereby provide more motor heat to the air drawn from the plenum chamber 10. If motor heat does not provide sufficient heat for the drying airstream, a small electric heater 71 can be mounted in the chamber 36.

Figure 3:
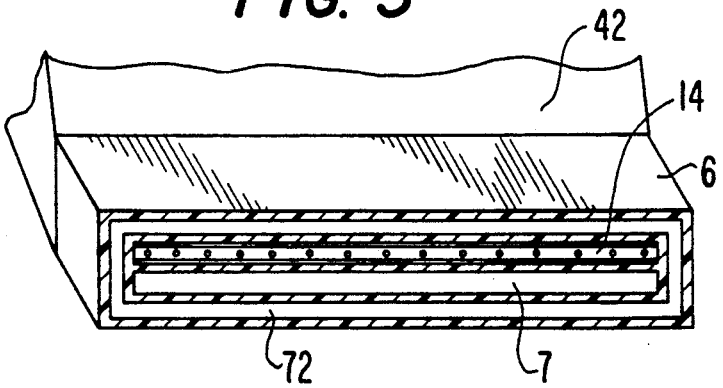
FIG. 3 is a perspective view of a second embodiment of a nozzle head for the recycling extraction heater and drier.

In FIG. 1, the nozzle head 6 is arranged with a drying air slot 40 extending across the rear of the nozzle head, a vacuum intake opening or slot 7 extending across the front of the nozzle head and the spray nozzle 14 extending therebetween across the nozzle head. However, as illustrated in FIG. 3, it may be desirable to apply drying air around the entire periphery of the nozzle head 6. For this purpose, instead of the single slot 40, the nozzle head is provided with four sided slot 72 which extends completely around the periphery of the nozzle head on all sides of the spray nozzle 14 and vacuum intake slot 7. Air passes down the conduit 38 and into the rear side of the slot 72 which extends through the nozzle head 6. The air spreads around the slot and exits on all sides of the nozzle head. Thus the spray nozzle 14 is surrounded by drying air which creates an air barrier around the spray nozzle and vacuum intake slot. This air barrier not only provides a drying function, but also concentrates the spray from the spray nozzle 14 and creates an air flow which enhances the removal of dirt and cleaning fluid by the vacuum system. The drying air under pressure increases the pressure differential between the plenum chamber 10 and the surface contacting underside of the nozzle head 6, thereby aiding in the pickup of cleaning fluid and dirt by the vacuum intake slot 7.

INDUSTRIAL APPLICABILITY

By providing a cleaning apparatus that is relatively small, lightweight, easily affordable, and versatile, and is not limited in its cleaning capacity to the surface area that can be cleaned with a single application of a quantity of cleaning with a single application of a quantity of cleaning fluid that is carriable thereby, the present invention enables such an apparatus to be produced in not only floor models, but hand held models, as well. Furthermore, the constructions in accordance with the present invention make the units produced in accordance therewith, simple and easy to use by unskilled cleaning help and the average consumer. Cleaning fluid may be applied by the apparatus to a surface to be cleaned and then recycled for reapplication to a new surface. Heated air is applied to dry fluid absorbed by the surface to be cleaned.

What is claimed is:

1. A recycling extraction cleaner and drier for cleaning a surface comprising:

a body member for housing internal cleaner components;

said body member including a vacuum blower chamber and a nozzle head formed at opposite ends of said body member, said nozzle head including a drying air discharge means, a cleaning fluid discharge head, and a vacuum intake means;

a fluid receiving chamber removably mounted on said body member adjacent to said nozzle head for containing cleaning fluid, means connecting said fluid receiving chamber to said cleaning fluid discharge head;

a plenum chamber formed on said body member between said vacuum blower chamber and said fluid receiving chamber, said plenum chamber being in communication with said fluid receiving chamber;

a vacuum generating means mounted on said body member in said vacuum blower chamber for creating a vacuum in said plenum chamber and an exhaust air flow in said vacuum blower chamber;

drying air conduit means extending within said body member from said vacuum blower chamber to said drying air discharge means, said drying air conduit means operating to conduct the exhaust air flow from said vacuum generating means to said drying air discharge means; and a vacuum conduit means connecting said vacuum intake means to said plenum chamber.

2. The recycling extraction cleaner and drier of claim 1 which includes at least one vent formed on said vacuum blower chamber for exhausting said exhaust air flow to atmosphere, and air flow control means mounted on said body member, said air flow control means operating to selectively open and close said vent to preclude exhausting said exhaust air flow to atmosphere when said vent is closed and to exhaust said exhaust air flow to atmosphere when said vent is open.

3. The recycling extraction cleaner of claim 2 wherein said air flow control means operates to block air flow to said drying air conduit means when said vent is open and to permit air flow through said drying air conduit means when said vent is closed.

4. The recycling extraction cleaner of claim 1 wherein said drying air discharge means includes an air discharge conduit extending around the periphery of said nozzle head to discharge said exhaust air flow along all sides of said nozzle head, said cleaning fluid discharge head and vacuum intake means being positioned on said nozzle head inwardly of said air discharge conduit.

5. The recycling extraction cleaner and drier of claim 1 wherein said drying air discharge means directs a stream of exhaust air against the surface to be cleaned, and said vacuum intake means is spaced from said fluid discharge head and said drying air discharge means and operates to remove fluid from said surface to be cleaned with dirt entrained in said fluid as well as air directed against said surface to be cleaned with dirt entrained in said air, said fluid and/or air being drawn by the vacuum in said plenum chamber through said vacuum intake means and vacuum conduit means to said plenum chamber.

6. The recycling extraction cleaner of claim 5 wherein said vacuum conduit means includes an outlet end positioned in said plenum chamber and deflection means mounted in said plenum chamber in spaced relationship to said outlet end of said vacuum conduit means, said deflection means operating to deflect material drawn into said plenum chamber through said vacuum conduit means toward said fluid receiving chamber.

7. The recycling extraction cleaner and drier of claim 5 which includes at least one vent formed on said vacuum blower chamber for exhausting said exhaust air flow to atmosphere, and air flow control means mounted on said body member, said air flow control means operating to selectively open and close said vent to preclude exhausting said exhaust air flow to atmosphere when said vent is closed and to exhaust said exhaust air flow to atmosphere when said vent is open.

8. The recycling extraction cleaner of claim 7 wherein said air flow control means operates to block air flow to said drying air conduit means when said vent is open and to permit air flow through said drying air conduit means when said vent is closed.

9. The recycling extraction cleaner of claim 8 wherein said drying air discharge means includes an air discharge conduit extending around the periphery of said nozzle head to discharge said exhaust air flow along all sides of said nozzle head, said cleaning fluid discharge head and vacuum intake means being positioned on said nozzle head inwardly of said air discharge conduit.

10. The recycling extraction cleaner of claim 9 wherein an air heating means is mounted in said vacuum blower chamber.

11. The recycling extraction cleaner of claim 5 wherein said drying air conduit means is integrally formed with said body member.

12. The recycling extraction cleaner of claim 11 wherein said body member is a unitary body member including a fluid chamber seating area formed between said nozzle head and said plenum chamber, said fluid receiving chamber being removably mounted in said fluid chamber seating area and including a container having an open end which communicates with said plenum chamber when said fluid receiving chamber is mounted in said fluid chamber seating area.

13. The recycling extraction cleaner of claim 12 wherein said body member includes a wall extending across a first side of said fluid chamber seating area between said plenum chamber and said nozzle head, said drying air conduit means being integrally formed with said wall.

* * * * *